US007028628B2

(12) United States Patent
Tsumiyama et al.

(10) Patent No.: US 7,028,628 B2
(45) Date of Patent: Apr. 18, 2006

(54) SIDE MIRROR STRUCTURE OF SMALL WATERCRAFT

(75) Inventors: Yoshinori Tsumiyama, Miki (JP); Tsutomu Shimizugami, Kakogawa (JP)

(73) Assignee: Kawasaki Jukogyo Kabushiki Kaisha, Kobe (JP)

( * ) Notice: Subject to any disclaimer, the term of this patent is extended or adjusted under 35 U.S.C. 154(b) by 0 days.

(21) Appl. No.: 10/975,150

(22) Filed: Oct. 27, 2004

(65) Prior Publication Data

US 2005/0092223 A1 May 5, 2005

(30) Foreign Application Priority Data

Oct. 31, 2003 (JP) ..... 2003-371636

(51) Int. Cl.
*B63B 35/73* (2006.01)

(52) U.S. Cl. ..... 114/55.5

(58) Field of Classification Search ..... 114/55.5
See application file for complete search history.

(56) References Cited

U.S. PATENT DOCUMENTS

| | | | | |
|---|---|---|---|---|
| 3,915,563 | A * | 10/1975 | Zimmer | 359/871 |
| 4,776,624 | A * | 10/1988 | Sakuma et al. | 296/1.11 |
| 5,619,950 | A * | 4/1997 | Ikeda | 114/363 |
| 6,070,846 | A * | 6/2000 | Shimokobe et al. | 248/475.1 |
| 2004/0168622 | A1 * | 9/2004 | Thompson et al. | 114/55.5 |

FOREIGN PATENT DOCUMENTS

| | | |
|---|---|---|
| JP | 2000-054705 | 2/2000 |

* cited by examiner

*Primary Examiner*—Jesus D. Sotelo
(74) *Attorney, Agent, or Firm*—Alleman Hall McCoy Russell & Tuttle LLP

(57) ABSTRACT

A side mirror structure of a small watercraft is provided. The small watercraft includes a steering handle, a hatch cover disposed in a deck portion in front of the steering handle, and a side mirror assembly fixed to the deck portion below the hatch cover lower.

4 Claims, 5 Drawing Sheets

SIDE MIRROR STRUCTURE OF SMALL WATERCRAFT

TECHNICAL FIELD

The present invention relates to a small watercraft and, particularly, to a side mirror structure which is suitable for small watercraft equipped with a hatch cover on a deck portion in front of a steering handle.

BACKGROUND OF THE INVENTION

A type of small watercraft which is configured to be steered by a bar-shaped steering handle is referred to as a Personal Watercraft or, simply, a PWC. The PWC typically includes a storage space in a deck portion in front of the steering handle, as disclosed in, for example, Japanese Patent No. 2927418. The storage space is covered by a hatch cover, which is typically configured to be pivotably provided in the deck portion so as to be opened and closed manually.

The watercraft is typically provided with a pair of side mirror assemblies positioned on the right and left sides of a resin handle cover that covers the steering handle, or on the right and left sides of the hatch cover in front of the steering handle. If the side mirror assemblies are configured to be coupled with the handle cover, a mirror portion of each of the mirror assemblies is normally coupled with a stay portion of the respective mirror assembly so as to be sufficiently extend laterally outward from the handle cover, in order to obtain a clear rear view. However, with this configuration, the mirror portion tends to pick up more vibrations from the watercraft body, and fails to be compact.

If the mirror assembly is configured to be coupled with the hatch cover, the side mirror assembly is directly coupled with a rear portion of the hatch cover. With this configuration, since the hatch cover is configured to be pivotably coupled to the deck portion, the hatch cover is not typically configured to be rigidly coupled with the deck portion of the watercraft with a shock-absorbing member is provided therebetween. Therefore, the side mirror assembly, which is coupled with the hatch cover, tends to receive undesirable vibrations from the watercraft body. Further, as mentioned above, since the hatch cover is pivotably coupled with the deck portion at a front end portion thereof and opening-and-closing operation is carried out manually, the side mirror assembly provided in the rear portion of the hatch cover makes the pivoting operation of the hatch cover even heavier.

BRIEF SUMMARY OF THE INVENTION

The present invention addresses the above conditions and provides a side mirror structure of a small watercraft, which can make the watercraft compact, receive less unexpected vibration (undesirable vibration) from the watercraft body, and which does not make opening-and-closing operation of a hatch cover difficult.

In one aspect of the present invention, the hatch cover of the watercraft is provided in a deck portion in front of a steering handle, and the side mirror assembly is fixed to the deck portion below the hatch cover.

With the above configuration, since the side mirror assembly is fixed to the deck portion below the hatch cover arranged in front of the steering handle, the watercraft is compact with the side mirror assembly having a small protrusion to a side, and the side mirror assembly receives significantly less unexpected vibration from the hatch cover.

Note that it is easier to design the side mirror assembly to control vibration directly transmitted from the deck, instead of from or through the hatch cover. Moreover, the side mirror assembly does not affect opening-and-closing operation of the hatch cover.

In another aspect of the invention, the side mirror assembly may include two portions: a stay portion which is configured to be fixed to the deck portion and a mirror portion which is configured to be coupled with the stay portion. With this two-portion configuration of the side mirror assembly, the shape of the side mirror assembly need not closely conform to the shape of the deck and the hatch cover, and thus more flexibility is provided for the design of the side mirror assembly.

In still another aspect of the invention, the stay portion of the side mirror assembly may include an internal stay portion which is configured to be fixed to the deck portion and an external stay portion which is configured to cover the internal stay portion so that the internal stay portion is not exposed to the outside. With this configuration, since the internal stay portion is configured not to be exposed to the outside, flexibility in design of the internal stay portion is increased. Also, flexibility in the external stay portion design is increased since it is separated from the internal stay portion.

The mirror portion may be coupled with the internal stay portion through the external stay portion.

Since the external stay portion may be configured to indirectly contact the deck portion, the external stay portion does not receive vibrations from the deck portion directly and, thus, the mirror portion does not receive vibration from the deck portion directly, either.

The external stay portion, which covers the internal stay portion, may be formed in a bowl shape and may be formed with a storage space inside to utilize the inside space of the external stay portion more efficiently. The storage space may be used for relatively small items such as hand tools or small accessories.

The above and further objects and features of the invention will more fully be apparent from the following detailed description with accompanying drawings.

DETAILED DESCRIPTION OF THE INVENTION

The present invention will now be described in detail referring to the accompanying drawings illustrating the embodiments thereof. Hereinbelow, a personal water craft will be described as an example of the small watercraft according to the present invention.

Figure 1:
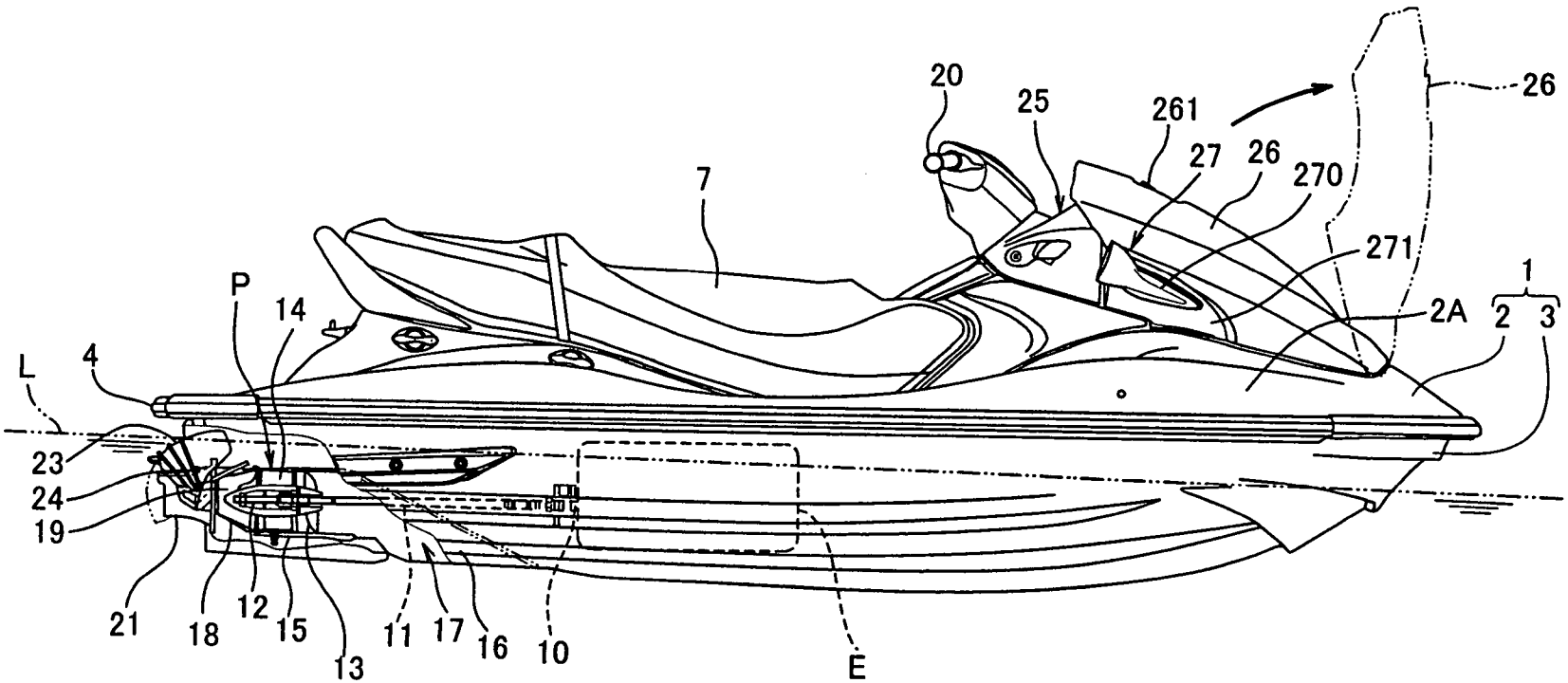
FIG. 1 is a side view of a small watercraft of an embodiment according to the present invention.
Figure 2:
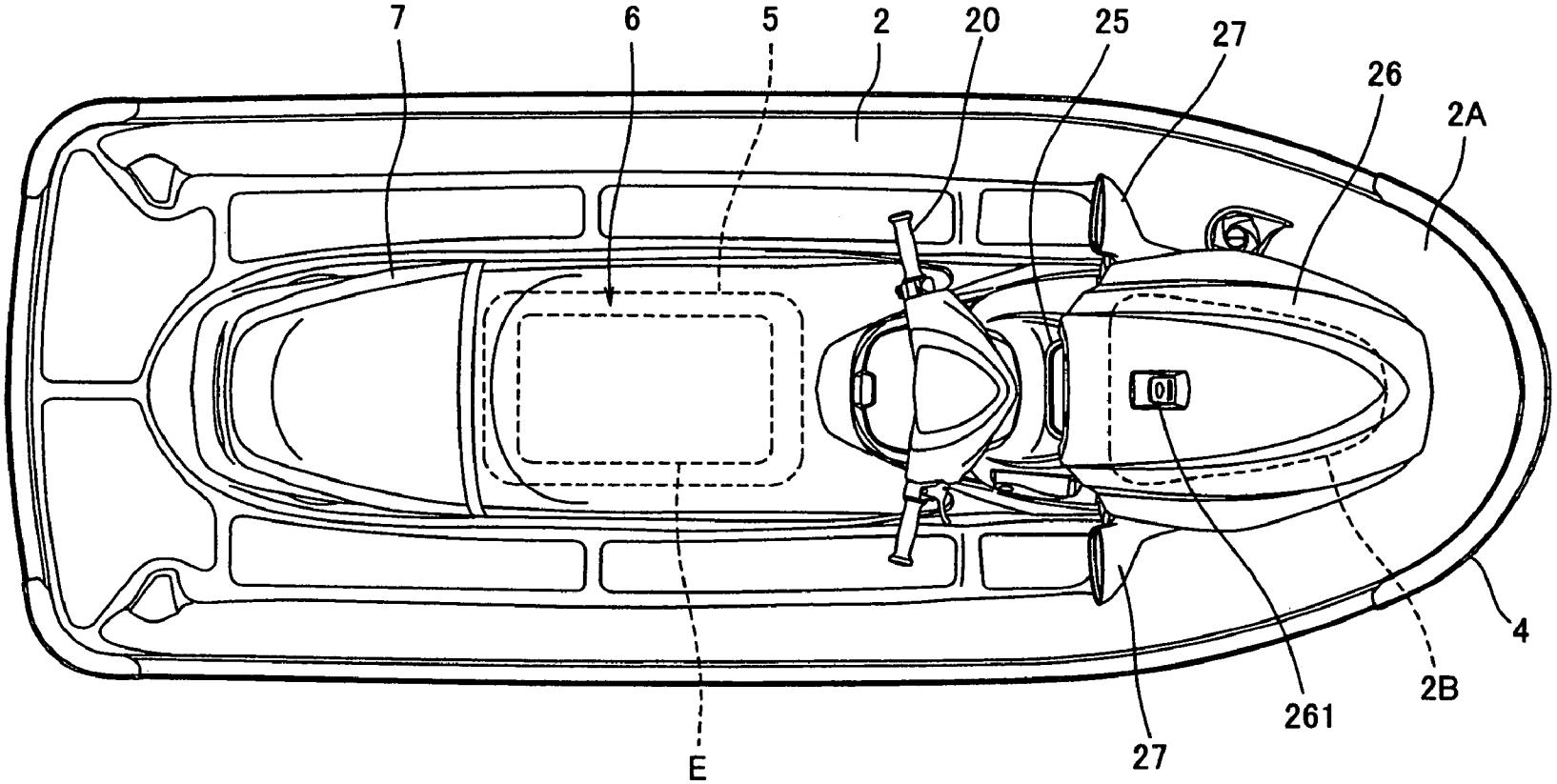
FIG. 2 is a plan view of the watercraft shown in FIG. 1.

FIG. 1 is a side view showing the entire personal watercraft of an embodiment according to the present invention, and FIG. 2 is a plan view of the personal watercraft shown in FIG. 1. As shown in FIGS. 1 and 2, a body 1 of the personal watercraft includes a hull 3 and deck 2 covering the hull 3 from above. The hull 3 and the deck 2 are connected at a gunnel line 4 which extends over the entire perimeter of the hull 3 and the deck 2. In this embodiment, the gunnel line 4 is normally located above a waterline L (which is shown in a double dot dashed line in FIG. 1) of the personal watercraft in a stationary condition.

As shown in FIG. 2, an opening 5 of substantially rectangular shape extending in the longitudinal direction of the watercraft is formed slightly rear of the middle section of the deck 2. The opening 5 is covered from above by a seat 7 which an operator straddles. An engine E is provided in a space 6 (usually referred to as "an engine room") surrounded by the hull 3 and the deck 2 below the seat 7.

As shown in FIG. 1, a crankshaft 10 of the engine E extends rearward, and a rear end portion of the crankshaft 10 is rotatably and integrally with a pump shaft 12 of a water jet pump P through a propeller shaft 11. An impeller 13 is attached on the pump shaft 12 of the water jet pump P. The impeller 13 is covered with a cylindrical pump casing 15 on the outer periphery thereof.

A water intake 16 is provided on the bottom of the hull 3. Water is sucked from the water intake 16 and fed to the water jet pump P through a water intake passage 17. The water jet pump P pressurizes and accelerates the water by rotation of the impeller 13. The pressurized and accelerated water is discharged through a pump nozzle 18 having a cross-sectional area of water flow that is gradually reduced in a rearward direction, and from an outlet port 19 provided on the rear end of the pump nozzle 18, thereby providing thrust. In FIG. 1, reference numeral 14 denotes fairing vanes for reducing turbulence in water flow behind the impeller 13.

As shown in FIGS. 1 and 2, a reference numeral 20 denotes a bar-type steering handle. The steering handle 20 operates in association with a steering nozzle 21 swingable around a swing shaft (not shown) to the right or to the left behind the pump nozzle 18. When the operator rotates the steering handle 20 clockwise or counterclockwise, the steering nozzle 21 is swung in opposite directions so that the watercraft can be correspondingly turned to any desired direction.

As shown in FIG. 1, a bowl-shaped reverse deflector 23 is provided above the rear section of the steering nozzle 21 such that it can swing downward around a horizontally mounted swinging shaft 24. The deflector 23 is swung downward to a lower position behind the steering nozzle 21 to deflect the ejected water from the steering nozzle 21 forward, and as the resulting reaction, the personal watercraft moves rearward.

In FIGS. 1, 2, a multi-function meter 25 is provided in a front deck portion 2A in front of the steering handle 20. Further in the front deck portion 2A in front of the multi-function meter 25, a front hatch cover 26 is provided, extended from a front end portion proximity to a bow of the watercraft to the multi-function meter 25. As shown in two-dot chain line in FIG. 1, the front hatch cover 26 is configured to be pivotable about an axis in the right-and-left direction (not shown) at a front end thereof. Opening and closing operation of the front hatch cover 26 about the axis is assisted by a spring-damper mechanism (not shown). The rear end portion of the hatch cover 26 extends slightly over the multi-function meter 25 so as to serve as a sun shade for the meter 25.

As shown with a dashed line in FIG. 2, a large-sized storage space 2B for life jackets, equipment, etc. is provided below the front hatch cover 26. The front hatch cover 26 can be opened and closed manually. To open, first, a user breaks the engagement between the front hatch cover 26 and front deck portion 2A by operating a lock mechanism 261 provided in an upper surface of the front hatch cover 26. Then, user lifts up the rear end portion of the front hatch cover 26 forward.

Figure 3:
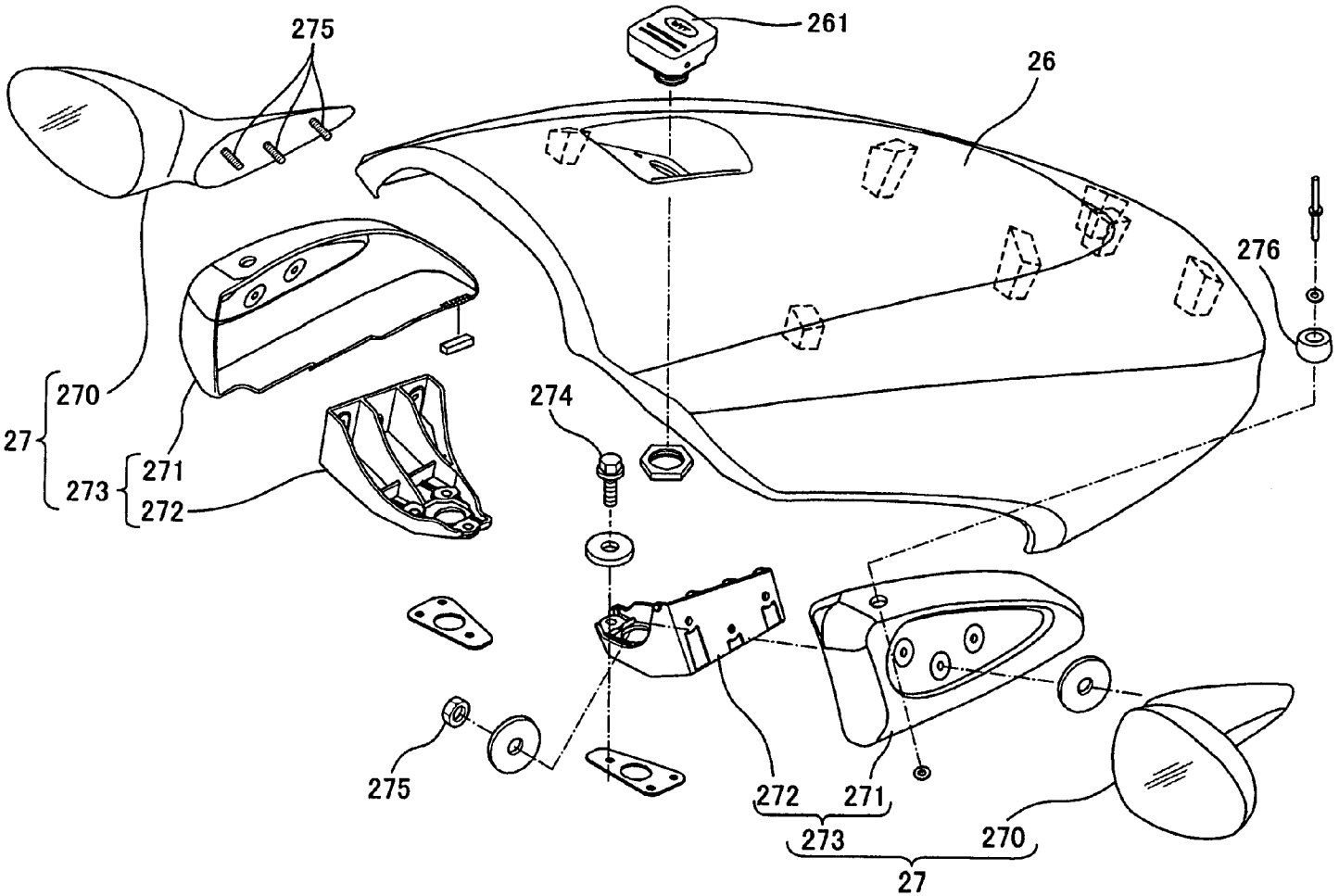
FIG. 3 is an exploded perspective view of a side mirror assembly of the embodiment according to the present invention shown in FIG. 1.

Side mirror assemblies 27 are disposed on each of the right and left side of the watercraft body, so as to be arranged symmetrically. Thus, the both side mirror assemblies 27 are substantially the same in structure. Typically, no part of either the side mirror assembly 27 is coupled with the front hatch cover 26 in this embodiment. However, instead, the side mirror assemblies 27 are directly coupled with the front deck portion 2A. As an exploded perspective view is shown in FIG. 3, the side mirror assembly 27 includes a mirror portion 270 and a stay portion 273. The stay portion 273 includes an external stay portion 271 and an internal stay portion 272.

Typically, the internal stay portion 272 is fixed to the front deck portion 2A in a position below the front hatch cover 26. The internal stay portion 272 may be fixed to the front deck portion 2A with three screws 274 (also see FIG. 5) at one end portion thereof. The other end portion of the internal stay portion 272 laterally extends outward from the one end portion and, curves upwardly away from the front deck portion 2A so as not to have a physical contact with the front deck portion 2A (also see FIG. 4). On a lateral outside end surface of the internal stay portion 272, the mirror portion 270 is coupled by three sets of bolts and nuts 275 from outside with the external stay portion 271 intervened therebetween (also see FIG. 5). The external stay portion 271 typically is formed in an elongated bowl shape in the front-and-rear direction of the watercraft so as to cover the internal stay portion 272 from outside, as well as to substantially fill spaces between the front deck portion 2A and the front hatch cover 26 so that the internal stay portion 272 is not exposed outside, as shown in FIG. 1. Moreover, a grommet 276, typically made of rubber, is provided to an upper surface of the external stay portion 271 to serve as a shock-absorbing member between the external stay portion 271 and the front hatch cover 26.

Figure 4:
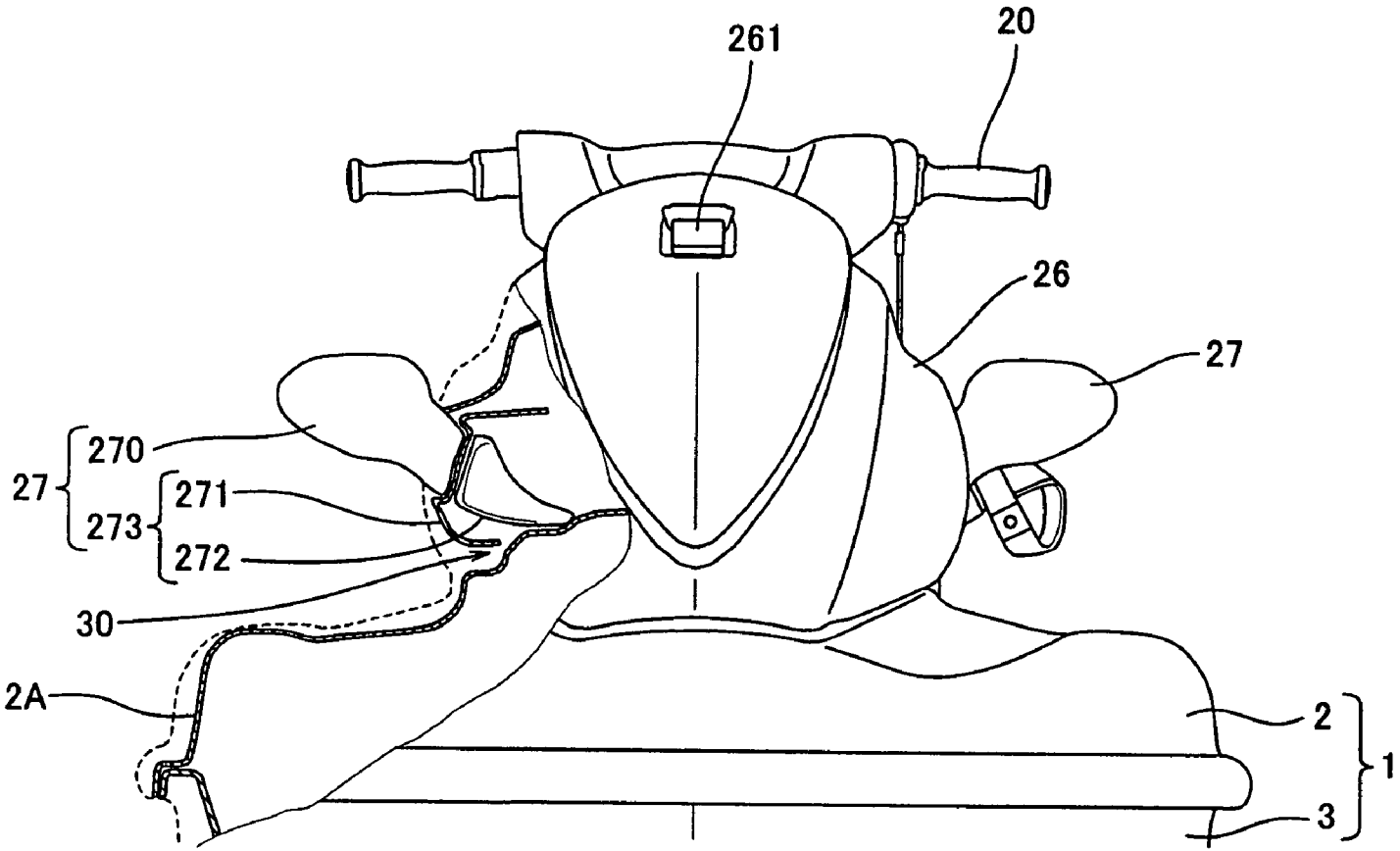
FIG. 4 is a partial cutaway, enlarged front view of the watercraft shown in FIG. 1.

As shown in FIG. 4, in the side mirror assembly 27 of this embodiment, only the internal stay portion 272 physically contacts with the front deck portion 2A, while the external stay portion 271 does not physically contact with the front deck portion 2A with a predetermined gap 30 between the front deck portion 2A at a bottom portion thereof. In this way, since the mirror portion 270 is coupled with the internal stay portion 272 through the external stay portion 271, the mirror portion 270 typically does not receive unpredictable vibrations through the front hatch cover 26. That is, the side mirror assembly 27 only receives vibrations directly from the front deck portion 2A, not through the front hatch cover 26. Although the mirror portion 270 receives vibrations from the front deck portion 2A through the internal and external stay portions 272, 271, it is relatively easy to predict such vibrations from engine E through the front deck portion 2A. Therefore, it is easy to design the side mirror assembly 27 with a natural frequency which does not resonate with a particular frequency of vibrations the engine E produces through the front deck portion 2A. In this embodiment, the mirror portion 270 is coupled with the other end portion of the internal stay portion 272, which is fixed to the front deck portion 2A at the one end, so that a natural frequency of the mirror portion 270 is easily offset from the resonance frequency caused by engine vibrations.

In FIG. 4, a dashed line indicates an outline of the front hatch cover 26 and the deck 2 below the front hatch cover 26. The cross-sectional portion in FIG. 4 is cut where the side mirror assembly 27 is installed. Therefore, the cross-sectional portion is apparently shown as unmatched with the dashed line which is a mirror image of the right side portion of the watercraft.

Moreover, since the mirror portion 270 and the external stay portion 271 which serves as a cover are only exposed outside, and they are provided independently from the front hatch cover 26, it provides easier coloring of the mirror portion 270, the external stay portion 271, the front hatch cover 26, and the deck 2 in a different color from surrounding surfaces, based upon a preference of user.

Figure 5:
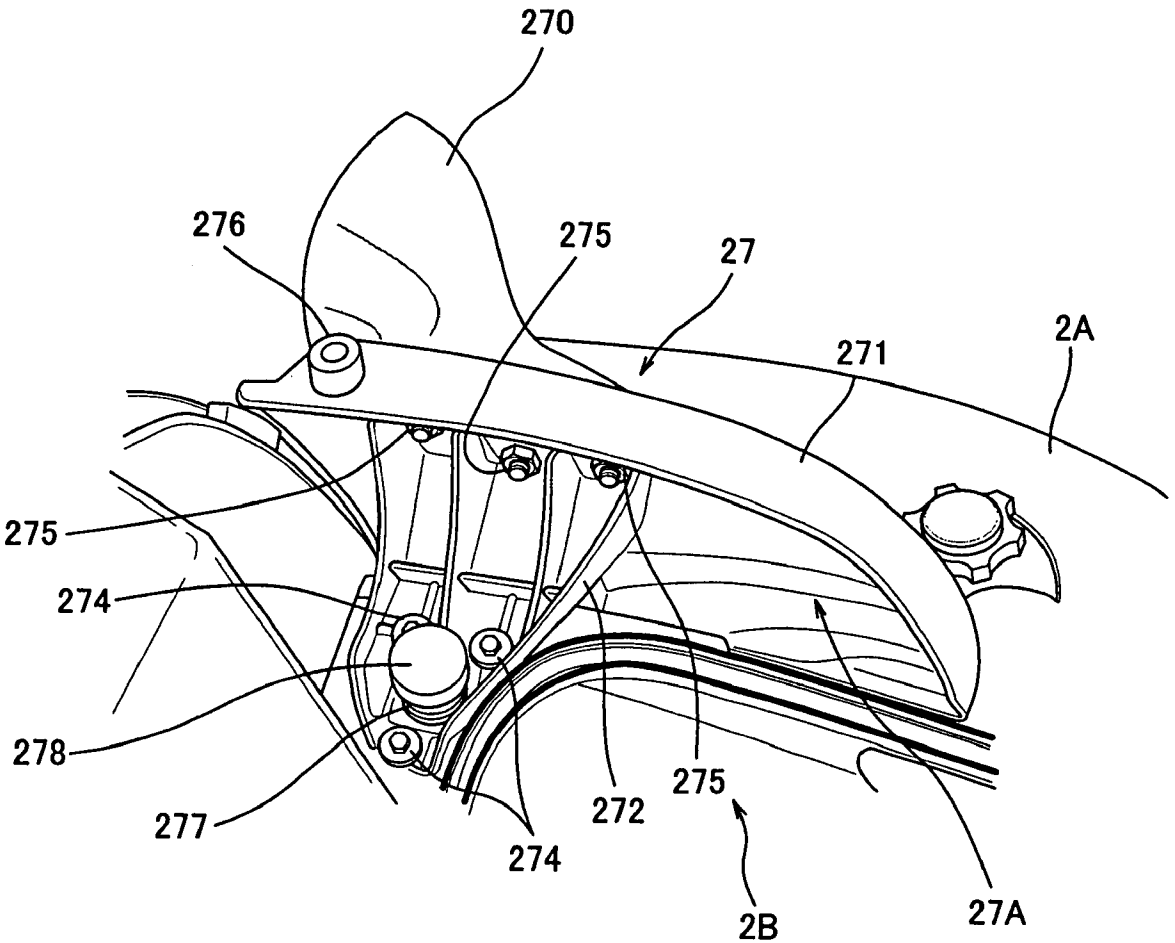
FIG. 5 is a perspective view showing an installation of the side mirror assembly (only left side is shown) to a front deck portion.

As shown in FIG. 5, in the one end portion (a coupling portion of the internal stay portion 272 with the front deck portion 2A), an inlet opening 277 for engine coolant is provided. The inlet opening 277 is covered and liquid-sealed with a cap 278 typically made of resin. Accordingly, when coolant is to be added, the front hatch cover 26 is swung open as mentioned above and, as a result, the inlet opening 277 is exposed for easy access. With this configuration, an inside space of the side mirror assembly 27 can be more effectively utilized and, the inlet opening 277 does not have to be located another location, such as a location difficult to access by user, or an exposed location which could limit body design of the watercraft.

Moreover, in this embodiment, in the inside space of the bowl-shaped external stay portion 271, a front portion in front of the internal stay portion 272 has a larger volume of empty space. This empty space may be utilized as a small storage space 27A for hand tools, waste cloths, etc., for further effective utilization of empty spaces.

As this invention may be embodied in several forms without departing from the spirit of essential characteristics thereof, the present embodiments are therefore illustrative and not restrictive, since the scope of the invention is defined by the appended claims rather than by the description preceding them, and all changes that fall within the metes and bounds of the claims, or equivalence of such metes and bounds thereof are therefore intended to be embraced by the claims.

The invention claimed is:

1. A small watercraft comprising:

a steering handle;

a hatch cover disposed in a deck portion in front of the steering handle, the hatch cover including a side wall having a cut-out portion formed therein, the cut-out portion and the deck portion below the cut-out portion defining an opening; and a side mirror assembly having a stay portion and a mirror portion, wherein the stay portion includes an internal stay portion and an external stay portion with a plate-shaped region;

wherein the internal stay portion includes a first end surface fixed to the deck portion below the hatch cover and a second end surface removably coupled with the mirror portion through the plate-shaped region of the external stay portion positioned therebetween;

wherein the second end surface of the internal stay portion is located in proximity to the opening, facing outside through the opening;

wherein the external stay portion is configured to cover the internal stay portion from at least above and laterally so that the internal stay portion is substantially unexposed to outside; and wherein the mirror portion is removably coupled to the external stay portion in a corresponding location on an opposite side of the external stay portion from the second end surface of the internal stay portion.

2. The small watercraft of claim 1, wherein the external stay portion is coupled with the deck portion through the internal stay portion without directly contacting the deck portion.

3. The small watercraft of claim 1, wherein the first end surface of the internal stay portion is substantially horizontal, and the second end surface of the internal stay portion is substantially vertical.

4. The small watercraft of claim 1, wherein the first end surface of the internal stay portion is provided with an inlet opening for engine coolant.

* * * * *